United States Patent [19]

Hultquist

[11] Patent Number: 4,740,024

[45] Date of Patent: Apr. 26, 1988

[54] SELF-TIGHTENING CLAMP

[76] Inventor: John V. Hultquist, 10500 Westminster Ave. #13, Garden Grove, Calif. 92643

[21] Appl. No.: 60,526

[22] Filed: Jun. 11, 1987

[51] Int. Cl.[4] ..... B66C 1/48

[52] U.S. Cl. ..... 294/116; 294/118

[58] Field of Search ..... 294/116, 118, 106, 104, 294/107, 82.13, 16, 28, 31.1, 110.2, 119; 29/283; 72/387, 705; 81/370, 371, 383.5

[56] References Cited

U.S. PATENT DOCUMENTS 126,818 5/1872 Lindsay ..... 294/118

3,870,359 3/1975 Hultquist ..... 294/118

*Primary Examiner*—James B. Marbert

*Attorney, Agent, or Firm*—Dean P. Edmundson

[57] ABSTRACT

A self-tightening clamp is described in which two clamping members are pivotally attached to each other intermediate their ends and include arms terminating in clamping jaws. An elongated pull bar having first and second ends is pivotally attached to one of the arms of the clamp. When the first end of the pull bar is pulled in an outward direction the second end of the pull bar is biased against one of the handles of the clamp to force the clamping jaws towards each other. The clamp may also include a cam on one of the arms for locking the jaws in a closed position. The clamp can be secured to a workpiece and pulled in any desired direction.

15 Claims, 3 Drawing Sheets

SELF-TIGHTENING CLAMP

FIELD OF THE INVENTION

This invention relates to clamps. More particularly, this invention relates to tong-type clamps in which a pair of clamping members are pivotally connected to each other intermediate their ends.

BACKGROUND OF THE INVENTION

Tong-type clamps have been in widespread use for various purposes, e.g., as ice tongs, wood clamps, and as various types of carriers. These types of clamps include a pair of clamping members which are pivotally connected to one another intermediate their ends. The portions of the clamping members extending in one direction from the pivot connection serve as handles for the clamp and the portions of the members extending in the other direction from the pivot connection serve as the clamping arms.

The clamping arms terminate in facing clamping jaws which are adapted to grip a workpiece therebetween. As the handles are moved toward one another the clamping arms correspondingly move together. Thus, in a lifting operation the heavier the workpiece, the more force exerted in moving the handle members toward one another and the tighter the grip exerted on the workpiece by the clamp jaws as the workpiece is lifted by the clamp.

These tong-type clamps have previously been provided with a locking mechanism to maintain the clamp in a set locked position. This is to minimize the danger of the workpiece being released from the clamp as it is being handled.

Various types of locking mechanisms have been previously used, as described in U.S. Pat. Nos. 2,301,079; 2,705,659; 2,059,972; 3,241,352; and 3,696,653. A preferred type of locking member is described in my prior patent, U.S. Pat. No. 3,870,359. This type of locking mechanism involves a movable cam member which is mounted on one of the clamping arms of the tong-type clamp.

A problem which is common to all of the tong-type clamps, however, is that the clamp must be pulled straight in order to maintain a tight grip upon the workpiece. Thus, such tong-type clamps cannot be pulled to the side or at an angle or else the clamp may lose its grip upon the workpiece. Thus, if a large pulling force is to be exerted upon the tong-type clamp then the pulling force must be generally in line with the central longitudinal axis of the clamp in order to assure that the clamp will not become separated from the workpiece.

In some situations, however, it may not be possible or it may not be desired to only exert a straight pulling force on a tong-type clamp. For example, in the automobile repair business it is often necessary to straighten an automobile body or frame by pulling the frame or body at a certain angle. It may not be possible or practical to align the tong-type clamp in the same direction as the pulling force which is required to straighten the body or frame. In such situations, if a conventional tong-type clamp is fastened to the workpiece and then pulled at an angle to the clamp, or is pulled sideways, for example, the clamp will probably be pulled loose from the workpiece because it is not capable of maintaining its gripping force when being pulled at such an angle. Even the presence of a locking means to maintain the clamping jaws in closed position may not be sufficient to overcome the tremendous force involved in pulling on the clamp at an angle when straightening an automobile body or frame or in other heavy duty operations.

There has not heretofore been provided a tong-type clamp which is suitable for pulling at any desired angle in heavy-duty situations.

SUMMARY OF THE INVENTION

In accordance with the present invention there is provided an improved tong-type clamp in which there is a pair of clamping members pivotally connected to one another intermediate their ends. The improvement comprises an elongated pull bar which has first and second ends and which is pivotally attached intermediate its ends to one of the arms of the clamp. The first end of the pull bar includes attachment means (e.g., a ring or loop for attachment of a pulling member such as a chain or cable). The second end of the pull bar is adapted to be biased against one of the handle elements of the clamp in a manner such that when the first end of the pull bar is pulled in an outward direction, then the second end of the pull bar is biased against one handle element to force the clamping jaws towards each other.

This improvement enables a pulling force to be exerted upon the clamp at any desired angle without danger of the clamp losing its grip upon a workpiece. The clamp may even be pulled sideways, i.e., at an angle of 90° to the longitudinal axis of the clamp. Thus, the improved tong-type clamp of the present invention may be used in various situations where a large pulling force is required (e.g., in automobile body repair) and where the pulling force must be exerted in a direction other than along the central axis of the clamp. This improved clamp is self-tightening.

Other advantages of the improved clamp of the invention will be apparent from the following detailed description.

BRIEF DESCRIPTION OF THE DRAWINGS

The invention is described in more detail hereinafter with reference to the accompanying drawings wherein like reference characters refer to the same parts throughout the several views and in which.

DETAILED DESCRIPTION OF THE INVENTION

Figure 1:
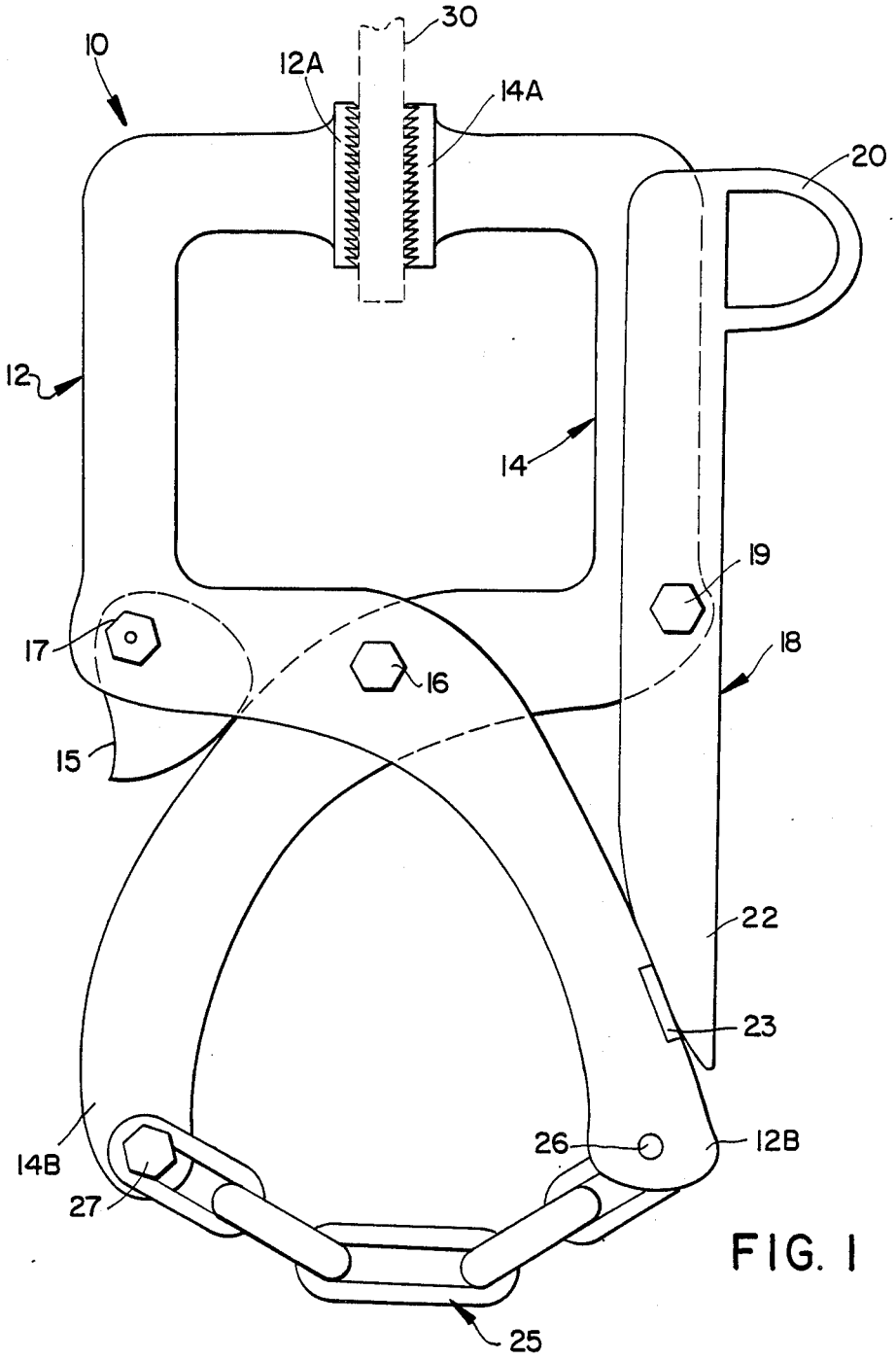
FIG. 1 is a front view of one embodiment of improved clamp of the invention.
Figure 2:
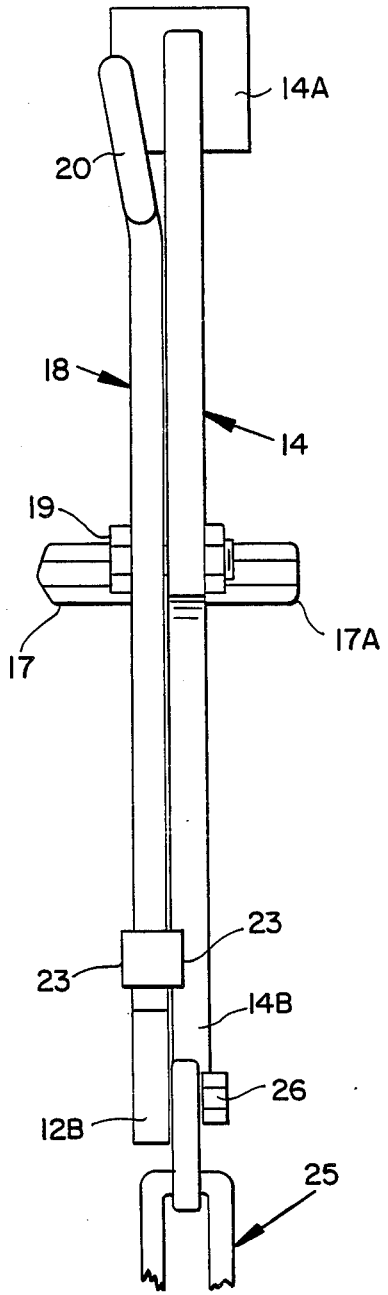
FIG. 2 is an edge view of the clamp shown in FIG. 1.

Thus, in FIGS. 1 and 2 there is illustrated an improved tong-type clamp 10 of the invention which includes clamping members 12 and 14 pivotally connected to each other intermediate their ends by bolt 16. On one side of the pivotal connection the clamping members terminate in facing clamping jaws 12A and 14A which are adapted to grip a workpiece 30, as illustrated. To the other side of the pivotal connection the clamping members include handle elements 12B and 14B, as illustrated.

On one of the clamping arms 12 there is movably attached a cam member 15 which can be rotated by turning nut 17 in a manner such that peripheral surface of the cam member engages handle element 14B. This prevents the handle member 14B from opening when the clamp is connected to workpiece 30 under normal conditions. Preferably the cam member 15 is attached to a shaft which extends completely through clamping member 12, with a nut located on each end of the shaft so that the cam may be rotated by turning the nut on either side of the clamping member 12. In FIG. 2 there is shown nut 17 on one side of the clamping member and nut 17A on the opposite side of the clamping member. Turning either of these will cause the cam member 15 to rotate.

Pivotally mounted on clamping member 14 is an elongated pull bar 18 which is mounted to clamping member 14 by means of bolt 19. The upper end of the pull bar 18 includes attachment means 20. The attachment means is shown in the drawing as a loop member or ring-shaped member. This is a convenient type of attachment means for attaching a chain or cable, etc.

The lower end 22 of the pull bar 18 includes a curved or slanted edge which is adapted to abut against handle element 12B when the upper end of the pull bar is pulled outwardly by means of loop or ring member 20. If desired, the lower end 22 of pull bar 18 may include tab members 23 for maintaining alignment of lower end 22 of pull bar 18 with the handle member 12B. These tabs prevent lower end 22 of pull bar 18 from slipping off the handle member 12B when a large pulling force is exerted on pull bar 18.

Preferably the handle members 12B and 14B are connected by means of a flexible pulling member, e.g. a chain or cable. The drawings illustrate use of a chain 25 which is secured to handle member 12B by means of bolt 26 and to handle member number 14B by means of bolt 27. This type of pulling member is advantageous because it is only necessary to attach a single pulling hook to the chain 25 when exerting pulling force on that end of the clamp, and the chain 25 automatically pulls the handle members 12B and 14B together, thereby maintaining gripping force between jaws 12A and 14A.

Figure 3:
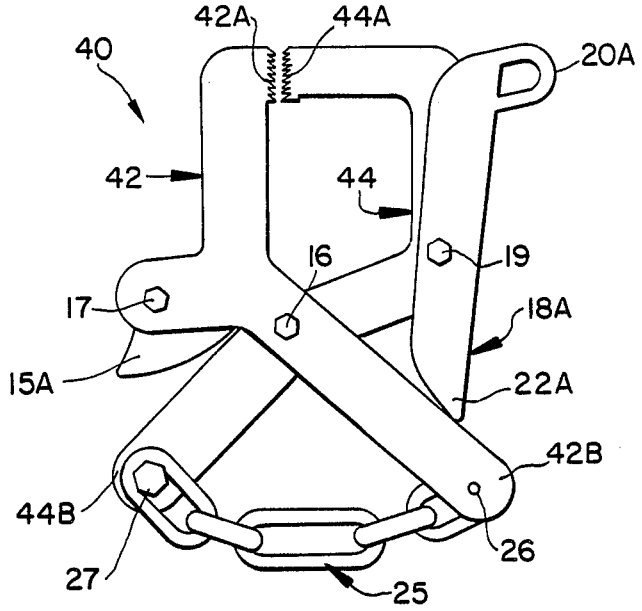
FIG. 3 is a front view of another type of improved clamp of the invention.

In FIG. 3 there is illustrated another tong-type clamp 40 of the invention comprising clamping members 42 and 44 which are pivotally connected intermediate their ends by bolt 16. The ends 42B and 44B comprise handle elements for the clamp. The opposite ends of the clamping members form facing clamping jaws 42A and 44A which are adapted to clamp a workpiece therebetween. Pulling bar 18A is pivotally attached by bolt 19 to the arm of the clamping member 44, as illustrated. The lower end 22A of pull bar 18A is adapted to abut against handle element 42B. When pulling force is exerted on loop or ring 20A at the upper end of the pull bar 18A, the lower end 22A of pull bar 18A is biased against handle element 42B and thereby increases the closing force of the clamp.

Moveable cam member 15A is attached to the clamping arm 42 by means of bolt 17, as illustrated. After the jaws of the clamp have been closed on a desired workpiece, the cam member 15A is rotated in a manner such that the peripheral cam surface abuts against handle element 44B. A flexible pulling member 25 is connected between the ends of the handle elements 42B and 44B, as illustrated. Pulling force on the clamp 40 may be applied either at chain 25 (for a straight on pull) or at the upper end 20A of pull bar 18A (for a side pull), or the pulling force may be applied at both of these locations for an angle pull.

Figure 4:
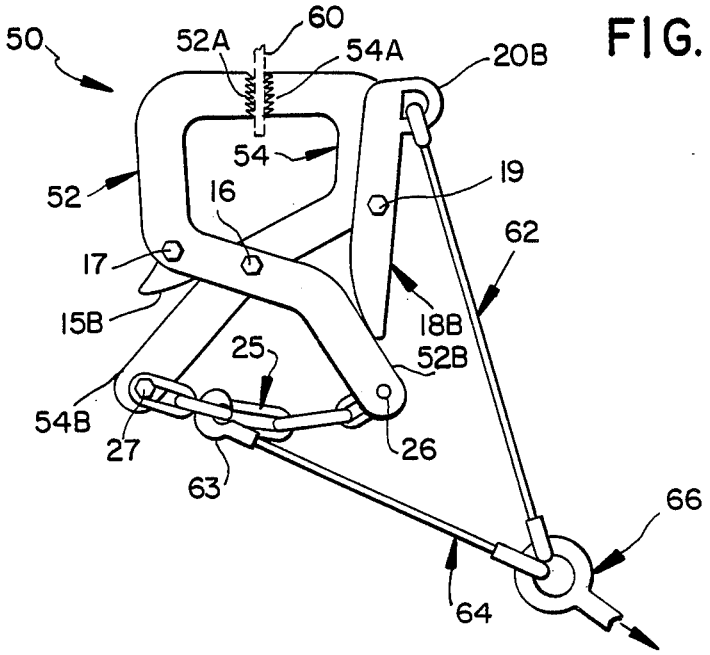
FIG. 4 illustrates one manner in which the clamp of the invention may be pulled at an angle to its central axis without danger of losing its gripping force.

For example, in FIG. 4 there is illustrated an improved clamp of the invention comprising clamping members 52 and 54 which are pivotally connected intermediate their ends by means of bolt 16. The facing clamping jaws 52A and 54A are clamped on a workpiece 60. The handle elements 52B and 54B are connected together by a means of chain 25, as illustrated. The pull bar 18B is connected, intermediate its ends, to clamping member 54 by bolt 19, as illustrated. In this illustration there is a pulling member 62 connected to loop 20B at the upper end of the pull bar, and pulling member 64 is connected by means of hook 63 to chain 25. The opposite ends of pulling members 62 and 64 are retained in ring 66. Pulling force can then be applied to the clamp by pulling on the ring 66 in the direction of the arrow. In this manner the resulting pulling force on workpiece 60 is at any desired angle between the direction of a straight pull and a side pull.

Consequently, by attaching pulling members to both the pull bar 18B and the chain 25 it is possible to have a pulling force at any desired angle between a straight pull and a side pull. This feature is extremely desirable in applications such as auto body repair where it is necessary to pull on the auto body or the frame of an automobile in a very specific direction in order to straighten it. By the use of the improved clamp of this invention it is possible to create the pulling force in the precise direction required without movement of the vehicle or movement of the source of the pulling force itself.

Other variations are possible without departing from the scope of the present invention. For example, the shape of the clamping members may vary. They are illustrated in some of the drawings accompanying this application as C-type clamping members. They are also illustrated (e.g. in FIG. 3) as including a combination of two types of clamping members to create an offset clamp. Still other variations in the style of the clamping members or jaws are permissible. When the clamping members or jaws are symmetrical, then the cam member and the pull bar may be mounted on either side of the clamp (i.e. they are interchangeable on the clamping arms). It is also possible to provide clamps of the invention which are left-handed or right-handed. That is, the clamps may be designed such that the pull bar is always on the left side or always on the right side of the clamp. The cam member may also vary in its specific style so long as it is capable of being rotated or pivoted to a position where it will lock against one of the handle elements to maintain the clamp in closed position.

Although the drawings illustrate the use of a nut on the end of a shaft on which the cam member is mounted, there may instead be used a lever to rotate the cam member to its desired position. It is also possible to use the improved clamp of the invention without the use of a cam member, if desired.

The clamp member made be made in any size, as desired. For example, the jaw members may be several inches long or they may be very short. Also, the thickness of the metal used in making the clamping members may vary, depending upon the intended use of the clamp and the severity of the forces which it must endure.

What is claimed is:

1. In a clamp of the type having a pair of clamping members pivotally attached to one another intermediate their ends, wherein the portions of said members to one side of the pivotal attachment comprise arms terminating in facing clamping jaws, and wherein the portions of said members to the other side of the pivotal attachment comprise handle elements, and wherein cam means is movably carried by the arm of one of said members for engagement with the handle element of the other of said members to hold the clamping jaws in clamped position upon clamping a workpiece therebetween; wherein the improvement comprises an elongated pull bar having first and second ends and being pivotally attached intermediate its ends to one of said arms; wherein said first end of said pull bar includes attachment means; wherein said second end of said pull bar is adapted to be biased against one of said handle elements in a manner such that when said first end of said pull bar is pulled in an outward direction, then said second end of said pull bar is biased against said one handle element to force said clamping jaws towards each other.

2. The improvement in accordance with claim 1, wherein said clamp comprises first and second clamping members, wherein said cam means is movably carried by the arm of said first clamping member, and wherein said pull bar is pivotally attached to the arm of said second clamping member.

3. The improvement in accordance with claim 2, wherein each said arm of said clamp is generally C-shaped.

4. The improvement in accordance with claim 2, wherein said attachment means at said first end of said pull bar comprises a closed loop member.

5. The improvement in accordance with claim 2, wherein said second end of said pull bar includes alignment tabs for aligning said second end of said pull bar with the handle element of said first clamping member.

6. The improvement in accordance with claim 2, wherein said cam means comprises a cam pivotally attached to said arm of said first clamping member, said cam having a curved peripheral surface, and wherein said other arm includes a surface adapted to abut with said peripheral surface of said cam.

7. The improvement in accordance with claim 6, wherein said cam is carried by a shaft having first and second ends, wherein said shaft extends through said arm of said first clamping member, and wherein a nut is secured to each of said first and second ends of said shaft.

8. A method for pulling a workpiece comprising the steps of:

(a) clamping said workpiece in said jaws of the clamp of claim 1;

(b) connecting said handle members of said clamp with a flexible connection member;

(c) simultaneously pulling on said connection member and said first end of said pull bar.

9. A method in accordance with claim 8, wherein said flexible connection member and said first end of said pull bar are each pulled from a common point.

10. In a clamp of the type having first and second clamping members pivotally attached to one another intermediate their ends, wherein the portions of said members to one side of the pivotal attachment comprise arms terminating in facing clamping jaws, and wherein the portions of said members to the other side of the pivotal attachment comprise handle elements; wherein the improvement comprises an elongated pull bar having first and second ends and being pivotally attached intermediate its ends to one of said arms; wherein said first end of said pull bar includes attachment means; wherein said second end of said pull bar is adapted to be biased against one of said handle elements in a manner such that when said first end of said pull bar is pulled in an outward direction, then said second end of said pull bar is biased against said one handle element to force said clamping jaws towards each other.

11. The improvement in accordance with claim 10, wherein each said arm of said clamp is generally C-shaped.

12. The improvement in accordance with claim 10, wherein said attachment means at said first end of said pull bar comprises a closed loop member.

13. The improvement in accordance with claim 10, wherein said second end of said pull bar includes alignment tabs for aligning said second end of said pull bar with the handle element of said first clamping member.

14. The improvement in accordance with claim 10, wherein said clamp further includes cam means comprising a cam pivotally attached to said arm of said first clamping member by means of a shaft having first and second ends.

15. The improvement in accordance with claim 14, wherein said shaft extends through said arm of said first clamping member, and wherein a nut is secured to each of said first and second ends of said shaft.

* * * * *